US006555038B1

(12) United States Patent
Egeler et al.

(10) Patent No.: US 6,555,038 B1
(45) Date of Patent: Apr. 29, 2003

(54) METHOD FOR PRODUCING AQUEOUS LIQUOR DYEABLE MODIFIED POLYPROPYLENE THREADS AND THE USE THEREOF

(75) Inventors: Sabine Egeler, Nürtingen (DE); Rainer Gutmann, Kornwestheim (DE); Winfried Schuler, Reutlingen (DE); Karl-Heinrich Wiese, Lauffen (DE)

(73) Assignee: Deutsche Institute fur Textil - und Faserforschung Stuttgart, Dendorf (DE)

( * ) Notice: Subject to any disclaimer, the term of this patent is extended or adjusted under 35 U.S.C. 154(b) by 0 days.

(21) Appl. No.: 09/529,929

(22) PCT Filed: Oct. 22, 1998

(86) PCT No.: PCT/EP98/06700

§ 371 (c)(1),
(2), (4) Date: Jun. 12, 2000

(87) PCT Pub. No.: WO99/20817

PCT Pub. Date: Apr. 29, 1999

(30) Foreign Application Priority Data

Oct. 22, 1997 (DE) ..... 197 46 635

(51) Int. Cl.[7] ..... D01F 6/06; D01F 6/30; D02G 3/02; D04H 3/00; D06B 1/00

(52) U.S. Cl. ..... 264/78; 8/494; 8/539; 8/928; 264/211; 264/211.22; 442/304; 526/351

(58) Field of Search ..... 264/78, 211, 211.22; 526/351; 442/304; 8/494, 539, 928

(56) References Cited

U.S. PATENT DOCUMENTS

| | | | | |
|---|---|---|---|---|
| 3,112,159 A | | 11/1963 | Cappuccio et al. | 264/78 |
| 3,261,885 A | * | 7/1966 | Craubner et al. | 525/183 |
| 3,862,265 A | * | 1/1975 | Steinkamp et al. | 525/285 |
| 5,246,769 A | * | 9/1993 | Murschall et al. | 428/216 |

FOREIGN PATENT DOCUMENTS

| | | |
|---|---|---|
| DE | 1131883 | 6/1962 |
| DE | 22 16 718 | 10/1972 |
| DE | 28 56 225 B2 | 7/1980 |
| EP | 0 114 379 A2 | 8/1984 |
| EP | 0 768 156 A2 | 4/1997 |
| GB | 946384 | 1/1964 |

OTHER PUBLICATIONS

Abstract of JP–48003214–B (no publication date given).*
Abstract of JP–48020833–A (published Mar. 15, 1973).*
Abstract of JP–54112990–A (published Sep. 4, 1979).*
Abstract of JP–3281554–A (published Dec. 12, 1991).*
Abstract of JP–4331248–A (published Nov. 19, 1992).
Abstract of JP–7003526–A (published Jan. 6, 1995).

* cited by examiner

*Primary Examiner*—Leo B. Tentoni
(74) *Attorney, Agent, or Firm*—Fay, Sharpe, Fagan, Minnich & McKee, LLP

(57) ABSTRACT

The invention relates to a method for producing aqueous liquor dyeable modified polypropylene threads. The inventive method is characterized in that a CR polypropylene suitable for fiber formation is mixed with a reaction partner which can react with CR polypropylene and the mixture obtained is processed in an extrusion spinning facility to form a thread. Suitable reaction partners are difunctional carboxylic acids, corresponding carboxylic acid derivatives or master batches made of polypropylene and difunctional carboxylic acids or corresponding carboxylic acid derivatives. The polypropylene threads obtained can be knitted to form textile fabrics. The polypropylene threads and textile fabrics can be dyed with the usual coloring agents according to a standard aqueous liquor extrusion process.

20 Claims, No Drawings

METHOD FOR PRODUCING AQUEOUS LIQUOR DYEABLE MODIFIED POLYPROPYLENE THREADS AND THE USE THEREOF

This application is the National Phase under 35 U.S.C. §371 of International Application PCT/EP98/06700 filed Oct. 22, 1998.

FIELD OF INVENTION

The invention concerns a method for producing aqueous liquor dyeable modified polypropylene threads, the polypropylene threads obtained with said method as well as the utilization of polypropylene threads for the manufacture of flat textile shapes. The invention concerns also a method for dyeing polypropylene threads and/or the textile shapes.

It is a known fact that it is difficult to dye unmodified polypropylene inasmuch as it can enter only into fragile Vander Waals interactions with a dyestuff molecule, based on its homopolar structure.

In order to nevertheless be able to dye polypropylene, the following dyeing methods are commercially employed at the present time.

According to one method, the threads are spin-dyed in that during the extrusion process a colored master batch granulate is used, which is prepared from a polypropylene type suitable for fiber formation and a suitable color pigment. While deep color tints are obtained with this method, the flexibility is low and productivity is limited inasmuch as the rinsing cycles required for any change in color and/or the resulting color mixtures permit only few color changes for reasons of economy.

Based on the rapidly changing, fashion-oriented color guidelines, however, more flexibility is desired at the present time. If the earlier mentioned so-called batch coloring mode is not desirable, it is also customary to achieve, for example by addition of nickelous salts to the polymer melt, an improved color acceptance capability of the polymer threads from an aqueous dye bath in that subsequently metallic compound dyes are employed in the aqueous bath dyeing process. This method, however, raises concerns due to ecological reasons because of the additions of heavy metal.

These two popular methods for dyeing polypropylene threads are described in M. Ahmed, Polypropylene Fibers—Science and Technology, Elsevier Publishing House, Amsterdam 1982.

Proceeding from the above described state of the art, it is the object of the present invention to make available a method for the production of modified polypropylene threads, which after standard extrusion method from an aqueous dye bath can be dyed with deep color tints of great intensity.

Said dyeing is to be achieve with commercially obtainable dyeing agents, using customary concentrations of dye. This method, in addition, shall have as few process steps as possible, thus resulting in cost savings and shall also be completely harmless ecologically.

According to the invention, said object is solved by a method which is characterized in that CR-polypropylene suitable for fiber formation is mixed with a reaction partner that can react with the CR-polypropylene and the obtained mixture is processed into threads in an extrusion-spinning fixture.

The term CR-polypropylene means a polypropylene type with controlled flow behavior (CR=controlled rheology).

The controlled flow behavior can be obtained can be obtained by various routes, for example by mechanical-thermal, γ-radiation, oxidation or by addition of peroxides. The most frequently employed method consists in that organic peroxides are added to the powdery polymer during the preparatory or processing step. Free radicals are formed in the heat, which preferably split off hydrogen from the statistically predominating longest hydrogen chains, resulting, via subsequent reactions, in chain splittings and thus produce a denser mol mass distribution, resulting in a higher melt index. The easy flowing CR-polypropylene thus contains, like any other thermal oxidatively stressed polypropylene type, hydroxyl groups. These occur in the named polypropylene types as forcibly produced end or side groups.

The melting index MFR (melt flow rate at 2.16 kg/10 min) of the employed CR-polypropylene lies in the range of approximately 10 to 1200. The melt index preferably lies in the range of approximately 15 to 300, particularly preferred is a range of approximately 20 to 120. The molecular weight of the employed CR-polypropylene therefore lies in the range of approximately 300,000 to 80,000, preferably in the range of approximately 250,000 to 110,000 and particularly preferred in the range of approximately 220,000 to 130,000.

It is of critical importance to select the reaction partner in such manner that same can react via its functional groups with CR-polypropylene, for example, cumulatively or via a substitute reaction. Consequently, permanent functionality is produced in the CR-polypropylene. Said functionality is then utilized in that during the dyeing in an aqueous dye bath, the respective dye substances react, in accordance with their interaction potentials, with the functional groups and thus produce intense and permanent color hues of the polypropylene thread. It is only due to said subsequent installation according to the invention of reactive groups in the polypropylene chain that the required anchoring groups are available, which are able by other than Van der Waals compounds, for example, ionic or co-valent binding mechanisms, to interact in stronger measure with the respective coloring agents, which thus make possible more intense color tints.

According to the invention, CR-propylene, suitable for formation of fibers, is processed jointly with a certain reaction partner, as a result of which the needed prerequisites are created during extrusion and in fiber formation, that in a future dyeing process an employed coloring substance can be applied from an aqueous dye bath and, furthermore, that it will possess satisfactory adhesive property. In difference to subsequent grafting methods, which may result in modifications of the same kind, in accordance with the method according to the invention, no separate and consequently expensive processing step is needed. The invention thus not only opens up a cost-effective method, but also affords access to a hitherto barely reachable market which is determined by rapidly changing, fashion-oriented color trends. Another benefit of the invention lies in the fact that the CR-polypropylene can be employed relatively independently from its molecular weight and its molecular weight distribution.

It is of particular benefit to employ as reaction partner a difunctional carboxylic acid or a corresponding carboxylic acid derivative, specifically a carboxylic acid ester, a carboxylic acid anhydride, a carboxylic acid amide, a carboxylic acid imide, a carboxylic acid halogenide or a carboxylic acid nitrile. Based on their chemical structures, these compounds are particularly well suited for entering into a reaction with the polypropylene.

It is particularly beneficial to employ as reaction partner a master batch of polypropylene and a difunctional carboxylic acid or a corresponding carboxylic acid derivative. The utilization of this kind of master batch has the advantage that the preparation of the mixture of master batch and CR-polypropylene is particularly simple.

The reaction partner is employed in a quantity of up to approximately 12% by weight, preferably up to approximately 3% by weight, and specifically up to approximately 1% by weight. The lower the employed quantity of the reaction partner, the more cost effective the method.

When implementing the method according to the invention, it may be of benefit for accelerating the reaction to employ a peroxidic addition as reaction initiator. The initiator employed in customary quantities, whereby its weight percentage concentration lies lower by approximately the power of ten than that of the reaction partner. Inorganic and organic peroxides, such as for example 2.5 di-methyl-2,5-bis-(t.butylperoxy-hexane) have proven themselves as particularly suitable reaction initiators.

Mixing of the CR-polypropylene with the reaction partner is most simply done by mechanical method. In order to attain a homogenous distribution of the reaction partner and, if applicable, also of the reaction initiators in the polypropylene, it is of benefit to extensively mix the reaction mixture. This homogenous distribution is facilitated by the use of master batches.

For execution of the method, customary extrusion-spinning facilities are used. It is, however, of benefit if the extruder is equipped with dynamic and/or static mixing elements, since this realized further homogenization of the melt.

The extrusion and winding conditions of thread manufacturing lie within the scope of the usual values for the production of LOY and/or POY materials. It is, however, also possible, to exceed the traditional processing temperatures of polypropylene as a function of the melting point of the reaction partner. Mass temperatures in the extrusion/spinning facility of approximately 230 to 300° C. have proven to be particularly beneficial. As for the nozzle hole numbers (for example 13–22 hole) and the nozzle geometry (for example hole diameter=250 $\mu$m). The spinning nozzles also operate with conventional measurements, by means of which are preferably produced spin thread titers in the range of approximately 60–600 dtex and/or filament titers of approximately 5–15 dtex. With respect to preferred spin velocities in the range of approximately 300–3000 m/min, the spun filament threads possess residual expansion values on the order of 200–700%. This results, relative to any subsequent stretching procedure in order to reach a final elongation of approximately 25%, using applicable stretching ratios of approximately 1:6.4 to 1:2.4, in filament stretching titer of preferably approximately 2.5–3.2 dtex. The resistance to tearing obtained in the stretched filament threads lies in the range of approximately 50–60 cN/tex and thus is no different from threads that were produced from unmodified polypropylene.

The threads according to the invention can be further processed, subject to the customary conditions, into flat textile shapes, preferably into knitted fabrics.

Further object of the present invention is a method for dyeing the polypropylene threads and flat textile shapes according to the invention. As mentioned earlier, the polypropylene threads according to the invention and the flat textile shapes according to the invention can be dyed in simple fashion according to a standard extrusion method in an aqueous dye bath. It is possible using traditional coloring agent concentrations, proportionate to the product weight, to achieve shades of color with extremely high intensity. Almost any type of coloring substance can be used which is able to react, according to the invention, via its own functional groups with the polypropylene threads or the flat shapes. This results not only in an intense color shade but also in permanent coloring.

Acid dyes, dispersion dyes and reactive dyes as well cationic dyes have proven themselves as particularly suitable. When utilizing these dyes, it is possible to maintain the coloring specifications listed in the color charts issued by the dye manufacturers.

Lastly, in certain instances it may be a benefit to establish conditions relative to pH value, dyeing temperature and dyeing duration which differ from the conditions recommended by the manufacturers. It is possible to select pH values from strongly acid to strongly alkaline and high dyeing temperatures, even as high as approximately 135° C., in other words HT conditions. It is possible to increase the dyeing time to up to about 2 hours.

In addition, it is possible to employ other dyeing adjuvants, such as for example ionic and non-ionic wetting agents, dispersion agents, scooping agents, antistatic and equalizing agents as well as retarding agents.

Depending upon the employed dye type and its concentration, it is possible to obtain highly intensive color shades. The remission values of the dyed samples, measured at the absorption maximum, may clearly be below the 2% mark, which corresponds to K/S values in excess of 30. The one hour after treatment in tenside containing bath at boiling temperature, performed after the dyeing steps, which results in a barely visible coloration of the rinsing water, attests to excellent adhesive property of the dyes to the substrates.

In the following, the invention is explained in greater detail.

EXAMPLE 1

Commercial CR-polypropylene granulate for fiber application having a melt index of MFR-25 (melt flowrate, at 2.16 kg/10)—obtainable from Hoechst AG under the trade name Hostalen PPU 1780F1—is mechanically mixed with powdery pyro-mellitic acid-dianhydride in such manner that the percentage of the pyro-mellitic acid-dianhydride in the mixture totals 0.5% by weight. Said mixture is fed into the extrusion/spinning facility and processed into filament threads at a mass temperature of 285° C.

EXAMPLES 2 and 3

Granulate mixtures as described in Example 1, except for a mixing percentage of 1 or 3 percent by weight are processed into filament threads, under the same conditions as in Example 1.

EXAMPLE 4

Commercial CR-polypropylene granulate as described in example 1 is mixed with a master batch of polypropylene and maleic acid anhydride, obtainable from Hoechst AG under the trade name Hostamont TP ARR 504, so that a mixing percentage of 1.75% of maleic acid anhydride is contained in the mixture. This mixture is processed into filament thread in the extrusion/spinning facility at 235° C.

EXAMPLES 5 to 8

Granulate mixtures as described in examples 1 and 2, but provided with one each additional adjuvant in a concentration of 0.5 to 1 g/kg granulate mixture, are processed into filament threads at the temperatures mentioned in the named examples. The mentioned adjuvant is, in turn, a mixture consisting of low molecular polypropylene and 7.5% by weight of 2,5-di-methyl-2,5-bis(t.-butylperoxy-hexane).

EXAMPLES 9 to 12

Granulate mixtures as described in examples 5–8, except that they are employed pyro-mellitic acid dianhydride is replaced by caprolactum, are processed into filament threads at temperatures of 265° C.

EXAMPLES 13 to 15

Granulate mixtures from Example 1 described CR-polypropylene granulate and a self-prepared master batch consisting of the same CR-polypropylene, commercial polyamide PA 12-granulate and a peroxidic adjuvant as described in examples 5 to 8, the latter in a concentration of 1 g/kg master batch and another 1 g of the named peroxidic adjuvant per kilo of finished granulate mixture, are mixed in the appropriate proportions, so that the mixture contains a percentage of 0.5; 1 or 3% PA12 by weight. These mixtures are processed into filament thread at 265° C.

The most important manufacturing parameters as well as the relevant mechanical properties of the unstretch and the stretch filament threads are summarized in Table 1 below:

TABLE 1

| Example | 1 | 2 | 3 | 4 | 5 |
|---|---|---|---|---|---|
| Spin Velocity (m/min) | 300 | 300 | 300 | 300 | 300 |
| Addition (%) | | | | | |
| PMSA | 0.5 | 1 | 3 | | 0.5 |
| MA | | | | 1.75 | |
| CL | | | | | |
| PA12 | | | | | |
| Peroxidic addition (%) | 0 | 0 | 0 | 0 | 0.5 |
| Tear Resistance, unstretch [cN/tex] | 10.2 | 10 | 9.1 | 9.5 | 9.3 |
| Breaking Elongation, unstretch (%) | 574 | 636 | 618 | 483 | 674 |
| Titer unstretched [dtex] | 436 | 543 | 556 | 379 | 674 |
| A-module unstretch [cN/tex] | 52 | 78 | 83 | 49 | 62 |
| Tear Resistance, stretch [cN/tex] | 54.9 | 57.1 | 51.4 | 44 | 63.8 |
| Breaking elongation, stretched [%] | 29 | 29 | 27 | 25 | 23 |
| titer, stretched [dtex] | 99 | 98 | 100 | 84 | 82 |
| A-module, stretch [cN/tex] | 485 | 384 | 346 | 311 | 329 |
| Example | 6 | 7 | 8 | 9 | 10 |
| Spin Velocity (m/min) | 300 | 300 | 300 | 300 | 300 |
| Addition (%) | | | | | |
| PMSA | 0.5 | 1 | 1 | | |
| MA | | | | | |
| CL | | | | 0.05 | 0.05 |
| PA12 | | | | | |
| Peroxidic addition (%) | 0.1 | 0.05 | 0.1 | 0.05 | 0.1 |
| Tear Resistance, unstretch [cN/tex] | 9.5 | 9 | 8 | 8.8 | 8.6 |
| Breaking Elongation, unstretch (%) | 648 | 690 | 677 | 604 | 598 |
| Titer unstretched [dtex] | 534 | 544 | 545 | 516 | 549 |
| A-module unstretch [cN/tex] | 63 | 64 | 66 | 44 | 46 |
| Tear Resistance, stretch [cN/tex] | 56.2 | 63.5 | 43.7 | 65.7 | 58.3 |
| Breaking elongation, stretched [%] | 24 | 25 | 24 | 27 | 26 |

TABLE 1-continued

| | | | | | |
|---|---|---|---|---|---|
| titer, stretched [dtex] | 89 | 84 | 97 | 92 | 92 |
| A-module, stretch [cN/tex] | 339 | 334 | 424 | 377 | 415 |
| Example | 11 | 12 | 13 | 14 | 15 |
| Spin Velocity (m/min) | 300 | 300 | 300 | 300 | 300 |
| Addition (%) | | | | | |
| PMSA | | | | | |
| MA | | | | | |
| CL | 1 | 1 | | | |
| PA12 | | | 0.5 | 1 | 3 |
| Peroxidic addition (%) | 0.5 | 0.1 | 0.1 | 0.1 | 0.1 |
| Tear Resistance, unstretch [cN/tex] | 9.6 | 9.4 | 8.9 | 8.9 | 8.6 |
| Breaking Elongation, unstretch (%) | 575 | 579 | 635 | 653 | 679 |
| Titer unstretched [dtex] | 545 | 537 | 555 | 554 | 560 |
| A-module unstretch [cN/tex] | 53 | 53 | 52 | 49 | 66 |
| Tear Resistance, stretch [cN/tex] | 59.9 | 65.8 | 55.2 | 52.1 | 59.7 |
| Breaking elongation, stretched [%] | 27 | 24 | 26 | 26 | 25 |
| titer, stretched [dtex] | 99 | 90 | 92 | 95 | 87 |
| A-module, stretch [cN/tex] | 478 | 490 | 124 | 233 | 201 |

EXAMPLE 16

Knitted fabrics, produced from filament threads of example 4, are dyed in closed dye beaker according to the following program: After immersion into the bath at 60° C. and a 15 minute stay in the bath, the temperature is raised to 125° C. over a period of 45 minutes, dyeing at that temperature for 120 minutes, with subsequent cooling down to 50° C. over a period of 40 minutes. Removed the dyed samples and subject same to an after-treatment at boiling temperatures for 60 minutes in open bath with 1–2 grams per liter each of a polyglycol ether derivative and soda. Typically employed dye baths, with a liquor ratio of 1:50 and a pH-value between pH2 and pH10 hold, as a rule, 0.1–5% of catonic coloring agent and contain 5 g/l of an anionic, synergistic tenside mixture.

TABLE 2

| Material | Dye | Concentration | pH-value | K/S value |
|---|---|---|---|---|
| Example 4 | C.I. Basic Blue 5 | 3% | 4 | 34.66 |
| Example 4 | C.I. Basic Blue 5 | 3% | 6 | 36.69 |
| Example 4 | C.I. Basic Blue 5 | 3% | 8 | 40.30 |
| Example 4 | C.I. Basic Blue 5 | 3% | 10 | 38.48 |

What is claimed:

1. Method for producing aqueous liquor dyeable modified polypropylene threads, characterized in that a CR-polypropylene suitable for fiber formation is reacted with a reaction partner to form a reaction mixture and the obtained reaction mixture is processed into threads in an extrusion-spinning facility.

2. Method according to claim 1, characterized in that a difunctional carboxylic acid or a corresponding carboxylic acid derivative is employed as reaction partner.

3. Method according to claim 2, characterized in that a carboxylic acid ester, a carboxylic acid anhydride, a carboxylic acid amide, a carboxylic acid imide, a carboxylic acid halogenide or a carboxylic acid nitrile is employed as carboxylic acid anhydride.

4. Method according to claim 3, characterized in that pyromellitic acid di-anhydride or maleic acid anhydride is employed as carboxylic acid anhydride.

5. Method according to claim 3, characterized in that a polyamide or caprolactam is employed as carboxylic acid amide.

6. Method according to claim 1, characterized in that a master batch of polypropylene and a difunctional carboxylic acid or a corresponding carboxylic acid derivative is employed as reaction partner.

7. Method according to claim 1, characterized in that a reaction partner is employed in an amount of up to approximately 12% by weight.

8. Method according to claim 1, characterized in that in addition to the propylene and the reaction partner, a peroxide adjuvant is used.

9. Method according to claim 8, characterized in that the peroxidic adjuvant is employed in an amount of up to approximately 1% by weight.

10. Method according to claim 1, characterized in that the employed extrusion/spinning facility is equipped with an extruder with dynamic and/or static mixing elements.

11. Method according to claim 1, characterized in that the mass temperature in the extrusion/spinning facility amounts to approximately 230 to 300° C.

12. Method accord to claim 1 characterized in that the mixing is done by mechanical mode.

13. Polypropylene thread obtainable according to the method of claim 1.

14. Method for dyeing the polypropylene thread of claim 13 characterized in that the dyeing is effected with dyeing agents from aqueous liquor.

15. Method according to claim 1, characterized in that a reaction partner is employed in an amount of up to approximately 3% by weight.

16. Method according to claim 1, characterized in that a reaction partner is employed in an amount of up to approximately 1% by weight.

17. Method according to claim 8, characterized in that the peroxidic adjuvant is employed in an amount of up to approximately 0.5% by weight.

18. Method according to claim 8, characterized in that the peroxidic adjuvant is employed in an amount of up to approximately 0.1% by weight.

19. Textile shapes comprised of the polypropylene thread produced by the method of claim 1.

20. Method for the dyeing of the textile shapes of claim 19 wherein the polypropylene thread is dyed using dyeing agents from aqueous liquor.

* * * * *